US005384512A

United States Patent [19]

Kamohara et al.

[11] Patent Number: 5,384,512

[45] Date of Patent: Jan. 24, 1995

[54] ELECTRON GUN FOR CATHODE-RAY TUBE

[75] Inventors: Eiji Kamohara, Fukaya; Shigeru Sugawara, Saitama, both of Japan

[73] Assignee: Kabushiki Kaisha Toshiba, Kawasaki, Japan

[21] Appl. No.: 232,345

[22] Filed: Apr. 22, 1994

Related U.S. Application Data

[63] Continuation of Ser. No. 738,456, Jul. 31, 1991, abandoned.

[30] Foreign Application Priority Data

Jul. 31, 1990 [JP] Japan ..... 2-202641

[51] Int. Cl.[6] ..... H01J 29/48

[52] U.S. Cl. ..... 313/414; 313/448; 313/449

[58] Field of Search ..... 313/414, 448, 449

[56] References Cited

U.S. PATENT DOCUMENTS

| | | | |
|---|---|---|---|
| 4,701,677 | 10/1987 | Ashizaki et al. | 313/414 X |
| 4,814,670 | 3/1989 | Suzuki et al. | 313/414 X |
| 4,851,741 | 7/1989 | Shirai et al. | 313/414 X |
| 4,945,284 | 7/1990 | Shimoma et al. | 313/414 |
| 5,015,910 | 5/1991 | Takahashi et al. | 313/414 |
| 5,034,653 | 7/1991 | Cho et al. | 313/414 |

FOREIGN PATENT DOCUMENTS

| | | | |
|---|---|---|---|
| 0338570 | 10/1989 | European Pat. Off. . | |
| 0192250 | 11/1983 | Japan | 313/414 |
| 260029 | 2/1990 | Japan . | |

*Primary Examiner*—Donald J. Yusko
*Assistant Examiner*—Ashok Patel
*Attorney, Agent, or Firm*—Cushman, Darby & Cushman

[57] ABSTRACT

In an electron gun for a cathode-ray tube according to this invention, a quadrupole lens having a small spherical aberration and an asymmetrical lens are combined to properly focus an electron beam, thereby greatly reducing the size of a beam spot formed on a target on a screen.

11 Claims, 17 Drawing Sheets

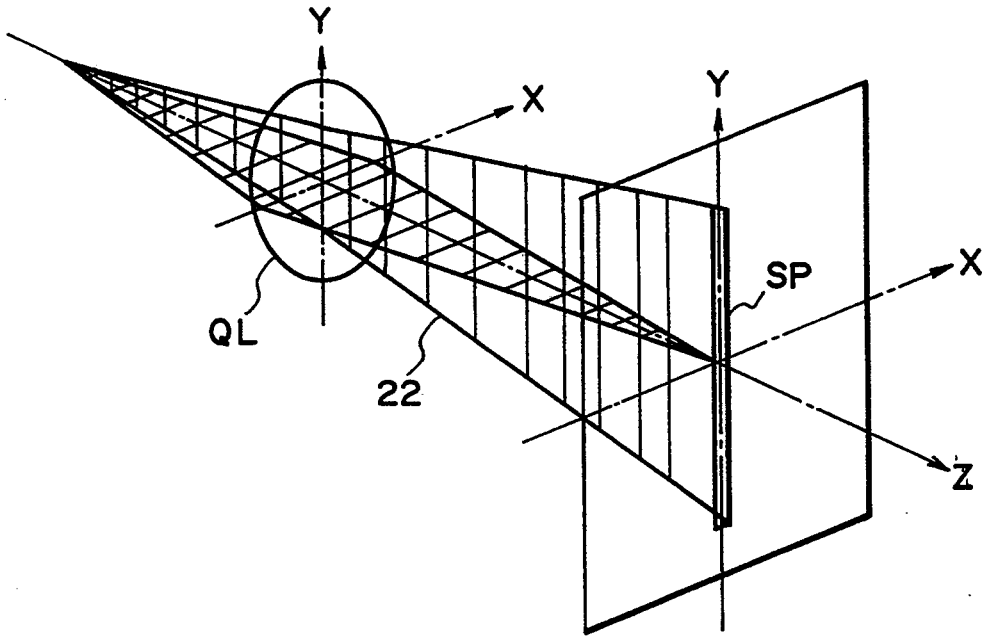
FIG. 7
FIG. 8A
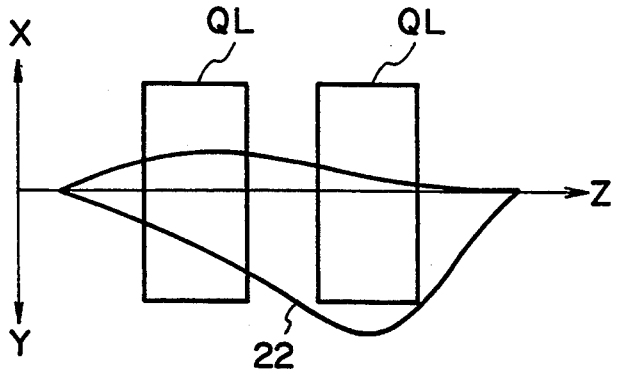
FIG. 8B
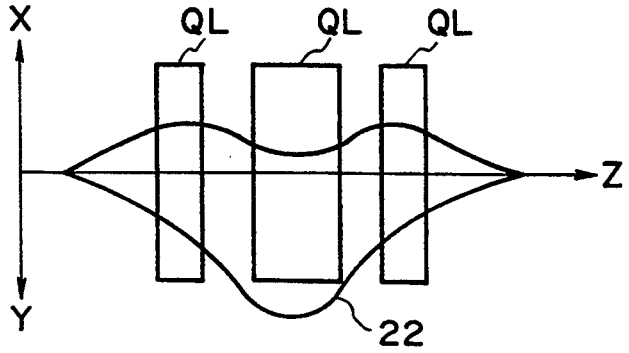

ELECTRON GUN FOR CATHODE-RAY TUBE

This is a continuation of application Ser. No. 07/738,456, filed on Jul. 31, 1991 now abandoned.

BACKGROUND OF THE INVENTION

1. Field of the Invention

The present invention relates to an electron gun for a cathode-ray tube and, more particularly, to an electron gun, used for a cathode-ray tube, which can optimize a beam spot on a target.

2. Description of the Related Art

In a cathode-ray tube such as a monochrome picture tube, a color picture tube, and a projection tube, an electron beam emitted from an electron gun is deflected by a magnetic field generated by a deflection yoke mounted around an envelope so as to be horizontally and vertically scanned on a phosphor screen (target) formed on the inner surface of the envelope. With this operation, an image is reproduced on the phosphor screen.

Electron guns of various schemes have been used for such cathode-ray tubes. Every conventional electron gun includes an electron beam forming portion, constituted by a cathode and a plurality of grids (electrodes), for controlling electrons emitted from the cathode and focusing the electrons to form an electron beam, and a main electron lens portion, constituted by a plurality of grids, for focusing the electron beam emerging from the electron beam forming portion onto a phosphor screen.

FIG. 1 shows such an electron gun. This electron gun comprises a cathode K and first to fourth grids G1 to G4 sequentially arranged at predetermined intervals from the cathode K to a phosphor screen 1. The first and second grids G1 and G2 are constituted by plate-like electrodes having relatively small electron beam passage holes formed in their surfaces according to the cathode K. The third and fourth grids G3 and G4 are constituted by cylindrical electrodes having relatively large electron beam passage holes formed in their end faces. In the electron gun, when predetermined potentials are applied to the cathode K and the first to fourth grids G1 to G4, an electron beam forming portion GEA is formed by the cathode K and the first, second, and third grids G1, G2, and G3, and a main electron lens portion MLA is formed by the third and fourth grids G3 and G4.

FIG. 2 shows an optical model of electron lenses formed in the electron gun. Electrons emitted from the cathode K are focused to form a crossover point CO owing to the effect of the cathode K and the first and second grids G1 and G2. The electrons are then slightly focused by a prefocus lens PL formed by the second and third grids G2 and G3 to form an electron beam 2. The electron beam 2 diverges and enters the third grid G3. The electron beam 2 which enters the third grid G3 is subsequently focused onto the phosphor screen 1 by the main electron lens portion constituted by a cylindrical electron lens portion MLA formed by the third and fourth grids G3 and G4.

In order to optimize image characteristics, especially resolution, of an image formed on the phosphor screen upon horizontal and vertical scanning of the electron beam 2, it is required that the size of the beam spot of the electron beam 2 focused on the phosphor screen 1 be minimized. Since a decrease in beam spot size is closely associated with the lens performance of an electron lens, the lens performance must be improved.

Especially the main electron lens portion MLA has conventionally employed several types of electrode arrangements. In order to improve the lens performance, however, the following two types of lenses are basically effective: a large-aperture electron lens obtained by increasing the diameter of an electron beam passage hole in each grid; and a long-focus electron lens which is obtained by increasing the grid pitch to realize small potential changes.

In general, however, since an electron gun for a cathode-ray tube is sealed within a neck constituted by a narrow glass cylinder, the size of an electron beam passage hole formed in each grid is geometrically limited. With this limitation, a corresponding lens aperture is limited. In addition, it is required that a focusing electric field formed between grids be free from the influences of other undesired electric fields formed in the neck. For this purpose, the grid pitch is also restricted. As a result, it is very difficult to improve the lens performance of an electron gun for a cathode-ray tube.

An in-line gun assembly for emitting three electron beams in line, which consists of a center beam and a pair of side beams propagating in the same plane, is widely used especially for a color cathode-ray tube. Since this electron gun assembly for emitting three electron beams in line must be sealed within a neck constituted by a narrow glass cylinder, electron beam passage hole through which the respective electron beams pass are inevitably reduced in size. This makes it more difficult to improve the lens performance.

With regard to an improvement in the lens performance of an electron gun for a color cathode-ray tube, for example, Published Unexamined Japanese Patent Application No. 1-267639 discloses an electron gun having a large-aperture electron lens common to the three electron beams. However, since the large-aperture electron lens of an electron gun disclosed in such an official gazette is a cylindrical lens, the problem of aberration is posed. Since aberration with respect to a pair of side beams is especially large, it is difficult to simultasneously reduce the sizes of the beam spots of the center beam and the pair of side beams on a phosphor screen. In addition, since the structure of such an electron lens is very complicated, a problem is posed in terms of practical applications.

As described above, in order to improve the resolution of a cathode-ray tube, the size of the beam spot of an electron beam focused on a phosphor screen must be minimized. For this purpose, it is required that the lens performance of each electron lens of an electron gun be improved. Especially with regard to a main electron lens portion, it is known to improve lens performance by employing either of the two types of electron lenses: a large-aperture electron lens formed by increasing the diameter of an electron beam passage hole in a grid, and a long-focus electron lens formed by increasing the grid pitch so as to have small potential changes. However, in an electron gun which is sealed within a neck constituted by a narrow glass cylinder, geometrical limitations are inevitably imposed on the lens aperture of such a large-aperture electron lens or on the grid pitch of such a long-focus electron lens. For this reason, it is very difficult to improve the lens performance of an electron gun for a cathode-ray tube. In addition, with regard to an in-line gun assembly for emitting three electron beams in line, which consists of a center beam and a pair of side beams propagating in the same plane, since this gun assembly must be sealed within a neck constituted by a narrow glass cylinder, an electron beam passage hole in each electrode is inevitably reduced in size. This makes it more difficult to improve the lens performance. In some electron gun assembly for a color cathode-ray tube, a large-aperture electron lens common to the three electron beams is formed to improve the lens performance. However, since the large-aperture electron lens of this conventional electron gun assembly is a cylindrical lens, the problem of aberration is posed. Since aberration with respect to a pair of side beams is especially large, it is difficult to simultaneously reduce the sizes of the beam spots of the center beam and the pair of side beams on a phosphor screen. In addition, since the structure of such an electron lens is very complicated, a problem is posed in terms of practical applications.

SUMMARY OF THE INVENTION

The present invention has been made in consideration of the above situation, and has as its object to greatly improve the lens performance of an electron gun for a cathode-ray tube, thus providing an electron gun which can greatly improve the resolution of a cathode-ray tube.

In an electron gun for a cathode-ray tube, which includes a cathode and a plurality of electrodes for forming an electron lens portion for focusing electrons emitted from the cathode to form an electron beam and focusing the electron beam onto a target, the electron lens portion includes a quadrupole lens, having a focusing effect in a first direction corresponding to one of orthogonal directions and a divergence effect in a second direction perpendicular to the first direction, for focusing the electron beam on the target mainly by the focusing effect in the first direction, and an asymmetrical lens, having a focusing effect mainly in the second direction, for exhibiting the focusing effect to suppress the divergence effect, in the second direction, of the quadrupole lens, thereby focusing the electron beam on the target.

In addition, the quadrupole lens is constituted by at least two quadrupole lenses, i.e. a first quadrupole lens having a focusing effect in the first direction and a divergence effect in the second direction perpendicular to the first direction, and a second quadrupole lens having a phase different from that of the first quadrupole lens.

Furthermore, the quadrupole lens is constituted by at least two quadrupole lenses, i.e., a first quadrupole lens having a focusing effect in the first direction and a divergence effect in the second direction perpendicular to the first direction, and a second quadrupole lens having the same phase as that of the first quadrupole lens.

If a quadrupole lens is arranged in the electron lens portion, as described above, since this quadrupole lens has a spherical aberration much smaller than that of a general cylindrical electron lens, the lens performance of the electron lens portion can be greatly improved. Although the quadrupole lens focuses an electron beam in one direction, it causes the electron beam to diverge in the other direction perpendicular to the focusing direction. For this reason, the quadrupole lens is used in combination with an asymmetrical lens having a focusing effect in the divergence direction to properly focus the electron beam, thus greatly reducing the size of a beam spot on the target.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a view for explaining the function of a quadrupole lens;

FIGS. 8A and 8B are views, each showing the structure of a combination of a plurality of known quadrupole lenses;

DETAILED DESCRIPTION OF THE PREFERRED EMBODIMENTS

Embodiments of the present invention will be described below with reference to the accompanying drawings.

Figure 1:
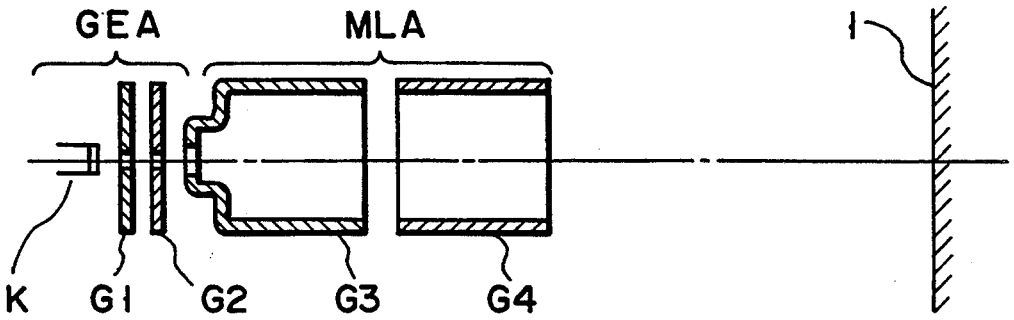
FIG. 1 is a sectional view showing the structure of a conventional electron gun.
Figure 2:
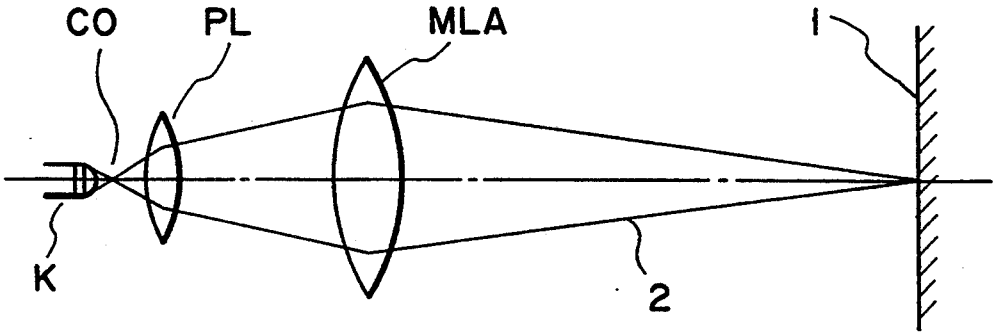
FIG. 2 is a view showing the arrangement of the electron lenses of the electron gun in FIG. 1.
Figure 3A:
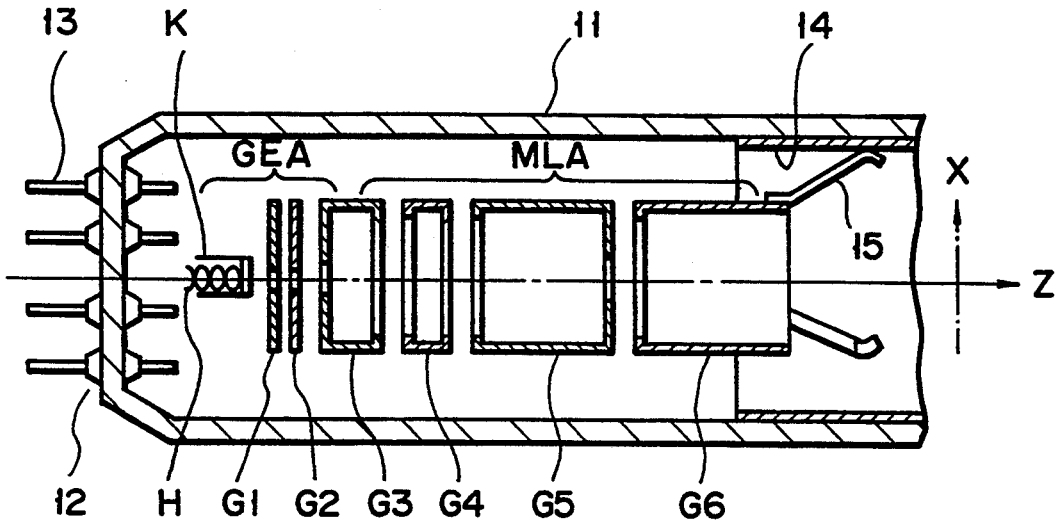
FIGS. 3A and 3B are X–Z and Y–Z sectional views showing the structure of an electron gun for emitting a single electron beam according to the first embodiment of the present invention.
Figure 3B:
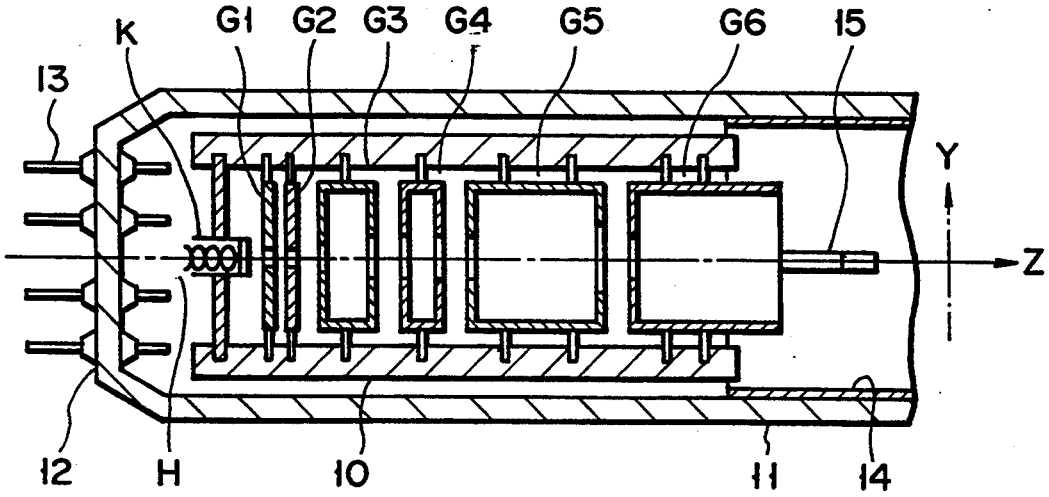

FIGS. 3A and 3B show an electron gun for emitting a single electron beam, according to the first embodiment of the present invention, which can be used for a monochrome picture tube or a projection tube.

This electron gun includes one cathode K, a heater H inserted in the cathode K, and first to sixth grids G1 to G6 coaxially arranged at predetermined intervals from the cathode K to a phosphor screen in the order named. The first and second grids G1 and G2 are formed as plate-like electrodes, and the third to sixth grids G3 to G6 are formed as cylindrical electrodes. The cathode K, the heater H, and the first to sixth grids G1 to G6 are integrally fixed to a pair of insulating support members 10.

Referring to FIGS. 3A and 3B, reference numeral 11 denotes a neck of an envelope; 12, a stem; 13, a stem pin airtightly extending through the stem 12; 14, an internal conductive film coated on the adjacent inner surfaces of the conical portion of the envelope and a portion of the neck 11; and 15, a valve spacer mounted on the sixth grid G6 to be in tight contact with the internal conductive film 14.

Figure 4A:
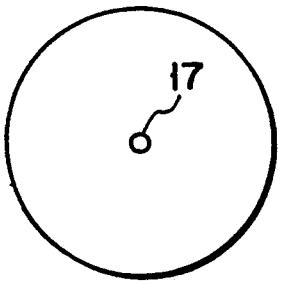
FIG. 4A is a view showing the shape of an electron beam passage hole of each of the first and second grids of the electron gun of the first embodiment.
Figure 4B:
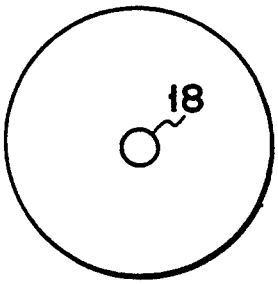
FIG. 4B is a view showing the shape of an electron beam passage hole in the end face of the second grid side of the third grid.

As shown in FIG. 4A, relatively small circular electron beam passage holes 17 are respectively formed in the plate surfaces of the first and second grids G1 and G2 to oppose the cathode K. In addition, as shown in FIG. 4B, a circular electron beam passage hole 18 slightly larger than the electron beam passage hole 17 of the second grid G2 is formed in the end face of the second grid G2 side of the third grid G3. The components from the cathode K to the third grid G3 constitute an electron beam forming portion GEA for controlling the emission of electrons from the cathode K and focusing the emitted electrons to form an electron beam.

Figure 4C:
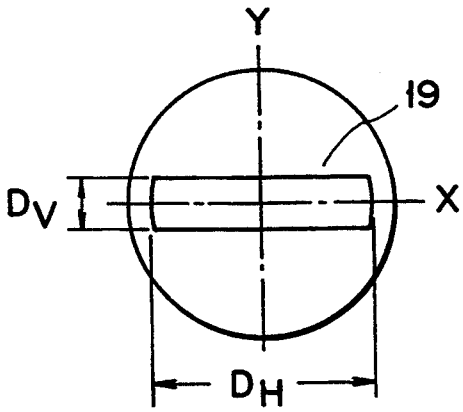
FIG. 4C is a view showing the shape of an electron beam passage hole in the end face of each of the following grid sides: the fourth grid side of the third grid, the third grid side of the fourth grid, the fifth grid side of the fourth grid, the fourth grid side of the fifth grid, and the fifth grid side of the sixth grid.
Figure 4D:
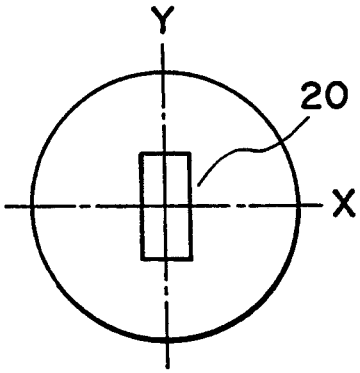
FIG. 4D is a view showing the shape of an electron beam passage hole on the fifth grid side of the sixth grid.

As shown in FIG. 4C, a horizontally (in the X-axis direction) elongated electron beam passage hole 19 is formed in the end face of each of the following grid sides: the fourth grid G4 side of the third grid G3, the third grid G3 side of the fourth grid G4, the fifth grid G5 side of the fourth grid G4, the fourth grid G4 side of the fifth grid G5, and fifth grid G5 of the sixth grid G6. In addition, as shown in FIG. 4D, a vertically (in the Y-axis direction) elongated electron beam passage hole 20 is formed in the end face of the sixth grid G6 side of the fifth grid G5. The components from the third grid G3 to the sixth grid G6 constitute a main lens portion MLA for focusing the electron beam emerging from the electron beam forming portion GEA onto the phosphor screen.

Voltages are applied to the respective electrodes of the electron gun through the stem pins 13 except for (Z axis) by the cathode K and the first and second grids G1 and G2 so as to form a crossover point CO. The electrons are then slightly focused in the horizontal and vertical directions by a prefocus lens PL formed by the second and third grids G2 and G3 to form an electron beam 22. The electron beam 22 diverges and enters the third grid G3.

The electron beam 22 which enters the third grid G3 is intensely focused, mainly in the vertical direction, by an asymmetrical lens VL (see FIG. 6C) of a unipotential type having a strong focusing effect in the vertical direction. The asymmetrical lens VL is formed by the horizontally elongated electron beam passage holes in the third, fourth, and fifth grids G3, G4, and G5. The asymmetrical electron lens VL which intensely focuses the electron beam 22 in the vertical direction is formed by setting a horizontal diameter Dh of the electron beam passage hole 19 in each of the third, fourth, and fifth grids G3, G4, and G5 to be sufficiently larger than a vertical diameter Dv of the hole 19 (see FIG. 4C). Note that the description "The electron beam 22 which enters the third grid G3 is intensely focused, mainly in the vertical direction, by an asymmetrical lens VL . . . " means that the asymmetrical lens VL may have a slight focusing effect in the horizontal direction in addition to the focusing effect in the vertical direction.

Figure 6A:
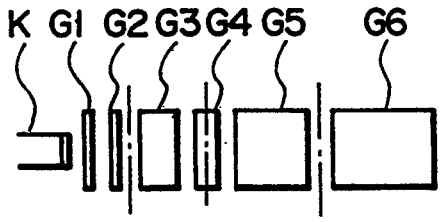
FIG. 6A is a view, showing the arrangement of electrodes in comparison with an electron lens, for explaining the function of each electron lens of the electron gun of the first embodiment.
Figure 6B:
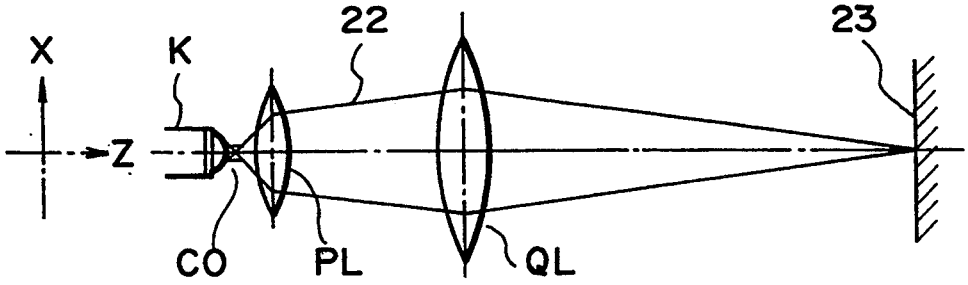
FIGS. 6B and 6C are views respectively showing the arrangement of the electron lens on the X–Z and Y–Z planes.
Figure 6C:
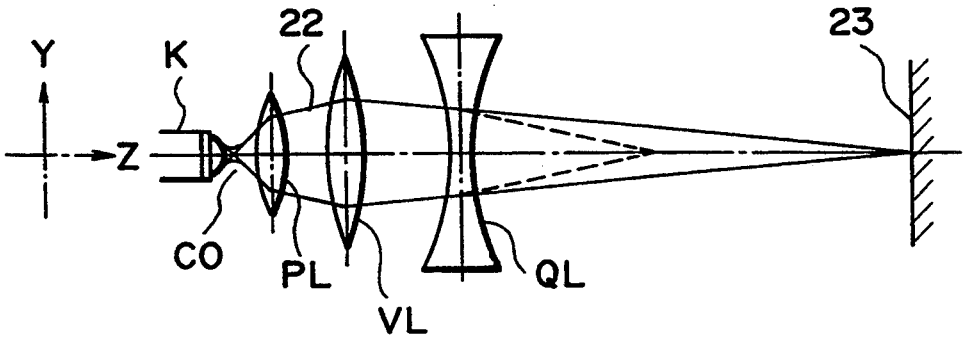

The electron beam 22 which is intensely focused mainly in the vertical direction is focused in the horizontal direction and is caused to diverge in the vertical direction, as indicated by solid lines in comparison with dotted lines in FIG. 6C, by means of a quadrupole lens QL formed by the vertically elongated electron beam passage hole 20 (see FIG. 4D) in the end face of the sixth grid G6 side of the fifth grid G5 and the horizontally elongated electron beam passage hole 19 (see FIG. 4C) in the end face of the fifth grid G5 side of the sixth grid G6. As a result, the electron beam 22 is horizontally and vertically focused on a phosphor screen 23 to form an image.

In the electron gun having the above-described arrangement, therefore, the electron beam 22 emerging from the electron beam forming portion GEA is focused by a main electron lens portion MLA constituted by the quadrupole lens QL. In this arrangement, a considerably large spherical aberration caused by a cylindrical electron lens formed in a conventional electron gun for a cathode-ray tube can be eliminated, and hence a beam spot formed on the phosphor screen 23 can be greatly reduced in size.

It is known that a quadrupole lens as an electron lens generally has a smaller aberration than a cylindrical lens. If, however, the quadrupole lens QL is simply used to form a given object point on a predetermined target, the electron beam 22 is focused in one direction (e.g., the horizontal direction) but is caused to diverge in the other direction (e.g., the vertical direction) perpendicular thereto, and a beam spot SP on the target (phosphor screen) is elongated, as shown in FIG. 7. For this reason, in some electron gun, a plurality of quadrupole lenses with opposite polarities are alternately arranged to simultaneously perform image formation in the horizontal and vertical directions. FIGS. 8A and 8B respectively show arrangements disclosed in "Electronic Optics" of Kyoritsu Zensho, Kyoritsu Shuppan K.K., (Japan), pp. 127–131. FIG. 8A shows a case wherein two quadrupole lenses QL are arranged. FIG. 8B shows a case wherein three quadrupole lenses are arranged symmetrically. If, however, a main electron lens portion is constituted by a plurality of quadrupole lenses in this manner, it is very difficult to set an electrode arrangement which can simultaneously perform image formation in the horizontal and vertical directions. In addition, since a lens operation greatly varies with fluctuations in electrode potential, an electron gun having such an arrangement is difficult to use.

If, however, the quadrupole lens QL is combined with the asymmetrical electron lens VL exhibiting a focusing effect mainly in the direction of the divergence effect of the quadrupole lens QL as in the electron gun of this embodiment, the problem based on the combination of only the plurality of quadrupole lenses as in the above-described cases can be solved. That is, the divergence effect of the quadrupole lens QL is canceled out by the focusing effect of the asymmetrical lens VL to greatly reduce the size of a beam spot on the phosphor screen 23. More specifically, the quadrupole lens QL is formed by the fifth and sixth grids G5 and G6 so as to optimally focus the electron beam 22 in the horizontal direction on the phosphor screen 23, and the asymmetrical electron lens VL constituted by the third, fourth, and fifth grids G3, G4, and G5 is formed in relation to the quadrupole lens QL to optimally focus the electron beam 22, thereby greatly reducing the size of a beam spot and greatly facilitating setting of an electrode structure and electrode potentials. As a result, a very practicable electron gun can be formed.

Figure 9A:
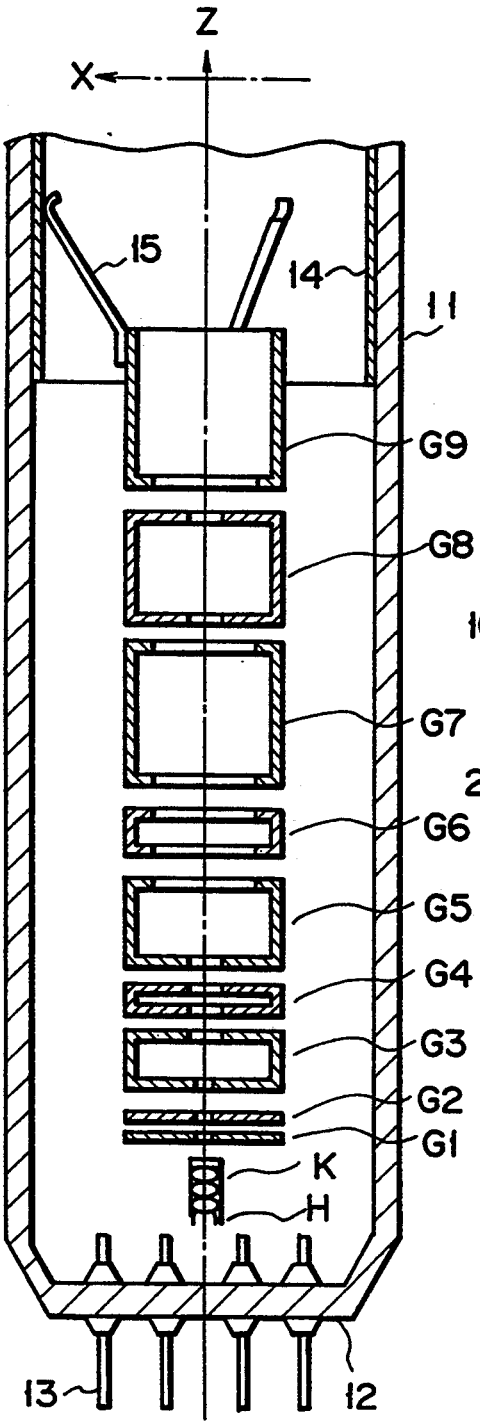
FIGS. 9A and 9B are X–Z and Y–Z sectional views showing the structure of an electron gun for emitting a single electron beam according to the second embodiment of the present invention.
Figure 9B:
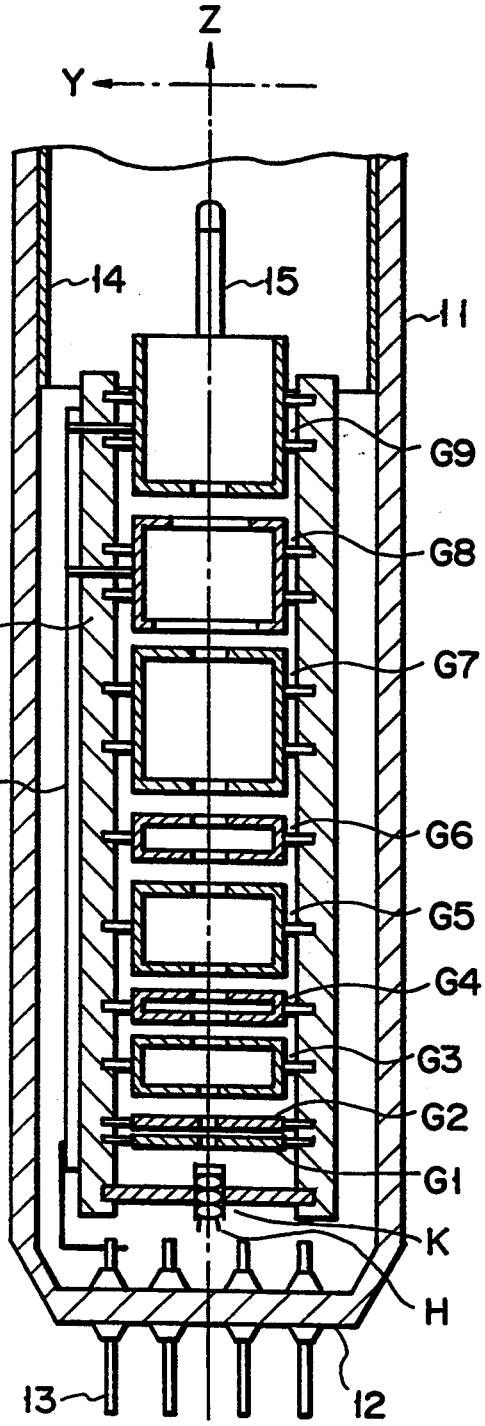

In second embodiment, FIGS. 9A and 9B show an electron gun in which at least one asymmetrical lens is combined with a plurality of quadrupole lenses in comparison with the electron guns shown in FIGS. 8A and 8B in which the plurality of quadrupole lenses QL are combined with each other.

This electron gun comprises one cathode K, a heater H inserted in the cathode K, and first to ninth grids G1 to G9 coaxially arranged at predetermined intervals from the cathode K to a phosphor screen in the order named. The first and second grids G1 and G2 are constituted by plate-like electrodes. The third to ninth grids G3 to G9 are constituted by cylindrical electrodes. The cathode K, the heater H, and the first to ninth grids G1 to G9 are integrally fixed to a pair of insulating support members 10. A resistive member 21 is arranged on the rear surface of one of the insulating support members 10.

Similar to the first embodiment, relatively small circular electron beam passage holes 17 are respectively formed in the plate surfaces of the first and second grids G1 and G2 to oppose the cathode K (see FIG. 4A). In addition, a circular electron beam passage hole 18 slightly larger than the electron beam passage hole 17 in the second grid G2 is formed in the end face of the second grid G2 side of the third grid G3 (see FIG. 4B). The cathode K and the first to third grids G1 to G3 constitute an electron beam forming portion GEA for controlling emission of electrons from the cathode K and focusing the emitted electrons to form an electron beam.

A circular electron beam passage hole having the same diameter as that of the electron beam passage hole the end face of the second grid G2 side of the third grid G3 is formed in the end face of each of the following grid sides: the fourth grid G4 side of the third grid G3, the third grid G3 side of the fourth grid G4, the fifth grid G5 side of the fourth grid G4, and the fourth grid G4 side of the fifth grid G5. In order to increase the electronic optic magnification of the electron gun, a relatively weak cylindrical lens is formed by the third, fourth, and fifth grids G3, G4, and G5, thus performing auxiliary focusing of an electron beam emerging from the electron beam forming portion GEA.

A horizontally elongated electron beam passage hole 19 is formed in the end face of each of the following grid sides: the sixth grid G6 side of the fifth grid G5, the fifth grid G5 side of the sixth grid G6, the seventh grid G7 side of the sixth grid G6, and the sixth grid G6 side of the seventh grid G7 (see FIG. 4C). An asymmetrical electron lens VL for focusing an electron beam in the vertical direction is formed by the fifth, sixth, and seventh grids G5, G6, and G7.

A horizontally elongated electron beam passage hole 19 similar to the electron beam passage hole in the seventh grid G7 is formed in the end face of each of the following grid sides: the eighth grid G8 side of the seventh grid G7, and the eighth grid G8 side of the ninth grid G9. Vertically elongated electron beam passage hole 20 are respectively formed in the end faces of the seventh grid G7 side of the eighth grid G8 and the ninth grid G9 side of the seventh grid G7 (see FIG. 4D). A quadrupole lens exhibiting a focusing effect in the horizontal direction and a divergence effect in the vertical direction is formed between the seventh and eighth grids G7 and G8. In addition, a quadrupole lens exhibiting a divergence effect in the horizontal direction and a focusing effect in the vertical direction with a phase difference of 90° with respect to the above-mentioned quadrupole lens is formed between the eighth and ninth grids G8 and G9.

Note that, in this electron gun, the components from the third grid G3 to the ninth grid G9 constitute a main lens portion MLA for focusing an electron beam emerging from the electron beam forming portion GEA onto the phosphor screen.

For example, a cutoff voltage of about 150 V is applied to the cathode K together with a video signal and the first grid G1 is set at the ground potential, thereby applying the following voltages to the respective electrodes: 500 V to 1 kV to the second grid G2; 8 to 15 kV to the third, fifth, and sixth grids G3, G5, and G6; 0 to 1 kV to the fourth grid G4; 1 V to 5 kV to the sixth grid G6; and 15 V to 25 kV, which is obtained by dividing a high anode voltage of 25 V to 30 kV for the ninth grid G9 by a resistive element 21, to the eight grid G8.

Figure 10A:
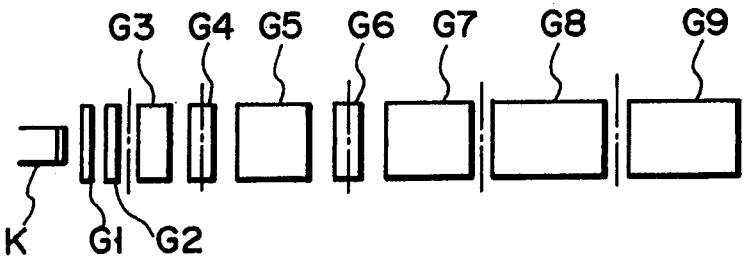
FIG. 10A is a view, showing the arrangement of electrodes in comparison with an electron lens, for explaining the function of each electron lens of the electron gun of the second embodiment.
Figure 10B:
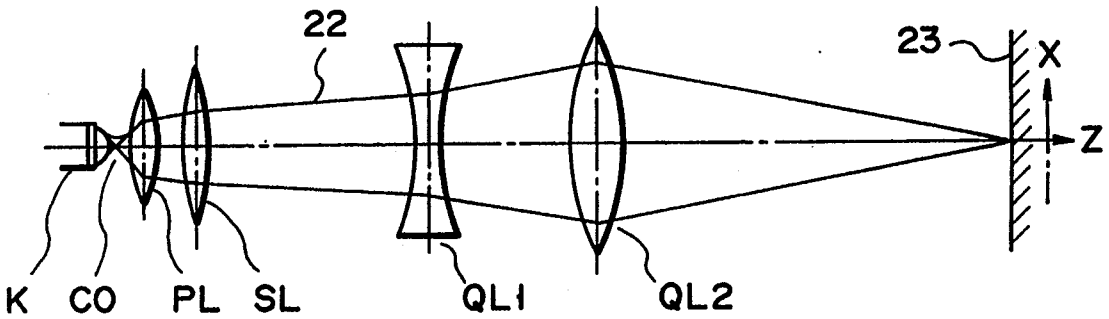
FIGS. 10B and 10C are views showing the arrangement of the electron lenses on the X–Z and Y–Z planes.
Figure 10C:
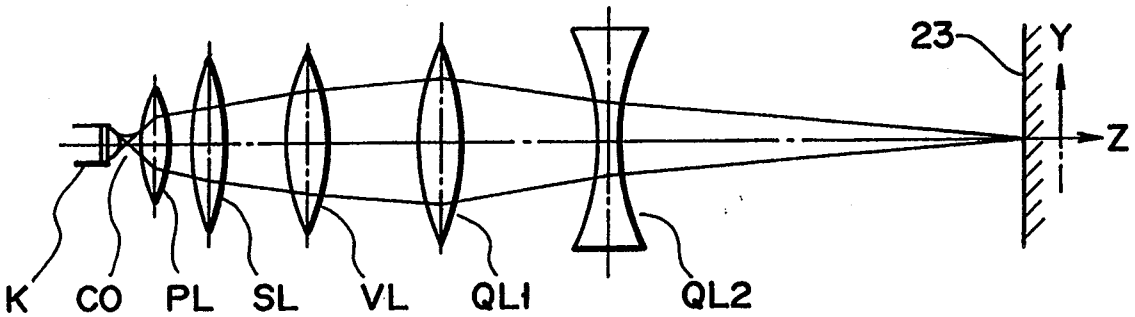

When such voltages are applied, electron lenses shown in FIG. 10C in comparison with the arrangement of electrodes in FIG. 10A are formed. More specifically, electrons emitted from the cathode K in accordance with a modulation signal are caused to cross the center axis (Z axis) by the cathode K and the first and second grids G1 and G2 so as to form a crossover point CO. The electrons are then slightly focused in the horizontal and vertical directions by a prefocus lens PL formed by the second and third grids G2 and G3 to form an electron beam 22. The electron beam 22 diverges and enters the third grid G3. The electron beam 22 which enters the third grid G3 is subjected to auxiliary focusing by a relatively weak cylindrical lens SL formed by the third, fourth, and fifth grids G3, G4, and G5. Furthermore, the electron beam 22 is vertically focused by an asymmetrical electron lens VL formed by the fifth, sixth, and seventh grids G5, G6, and G7.

Subsequently, in the horizontal direction, the electron beam 22, which has undergone this auxiliary focusing, is subjected to the divergence effect of a quadrupole lens QL1 formed by the seventh and eighth grids G7 and G8, and is subjected to the focusing effect of a quadrupole lens QL2 formed by the eighth and ninth grids G8 and G9. As a result, the electron beam 22 is focused on the phosphor screen 23. Meanwhile, in the vertical direction, the electron beam 22 is subjected to the focusing effect of the quadrupole lens QL1 formed by the seventh and eight grids G7 and G8, and is subjected to the divergence effect of the quadrupole lens QL2 formed by the eighth and ninth grids G8 and G9. As a result, the electron beam 22 tends to be focused on the phosphor screen 23. That is, the vertical focusing by the quadrupole lenses QL1 and QL2 is not necessarily proper focusing if the horizontal focusing is assumed to be proper focusing. However, the electron beam 22 can be properly focused vertically onto the phosphor screen 23 by means of a combination of the quadrupole lenses QL1 and QL2 and the asymmetrical electron lens VL formed by the fifth, sixth, and seventh grids G5, G6, and G7.

More specifically, in this method of performing proper focusing in the horizontal and vertical directions, while the voltage for the eight grid G8 is fixed, the voltages for the third, fifth, and seventh grids G3, G5, and G7 are externally adjusted to properly focus the electron beam 22 horizontally onto the phosphor screen 23. Subsequently, the potential of the sixth grid G6 is adjusted to properly focus the electron beam 22 onto the phosphor screen 23. With this operation, the electron beam is properly focused horizontally and vertically.

That is, in order to perform proper horizontal and vertical focusing on the phosphor screen 23 by using only a plurality of quadrupole lenses, the quadrupole lenses must be finely adjusted. In this case, focusing in the horizontal direction causes an electron beam to diverge in the vertical direction due to subtle influences of especially the structure and potential of each electrode. Such fine adjustment, therefore, is very difficult because of this inherent effect of this arrangement constituted by a plurality of quadrupole lenses. If, however, an asymmetrical lens is combined with such an arrangement, an easy-to-use, practicable electron gun can be formed.

In the second embodiment, the asymmetrical lens VL, the quadrupole lens QL1, and the quadrupole lens QL2 are sequentially arranged between the cathode K and the phosphor screen 23 in the order named, i.e., (a) asymmetrical electron lens VL+quadrupole lens QL1+quadrupole lens QL2.

However, the asymmetrical electron lens VL and the quadrupole lenses QL1 and QL2 may be arranged as follows:

(b) quadrupole lens QL1+asymmetrical electron lens VL+quadrupole lens QL2

(c) asymmetrical electron lens VL+quadrupole lens QL2+quadrupole lens QL1

Furthermore, in the second embodiment, two quadrupole lenses are used. However, three quadrupole lenses QL1, QL2, and QL3 may be used in combination with an asymmetrical electron lens VL. In this case, for example, these components are arranged as follows:

(d) asymmetrical electron lens VL+quadrupole lens QL1+quadrupole lens QL2+quadrupole lens QL3 In this arrangement, two of the three quadrupole lenses QL1, QL2, and QL3 may be constituted by lenses having the same phase and exhibiting the same lens effect in the same direction, while the remaining one lens is constituted by a lens having a different phase.

In the above embodiments, each asymmetrical electron lens is constituted by an electrode which has a horizontally elongated electron beam passage hole and is of a unipotential type. The asymmetrical electron lens, however, is not limited to this but may be of a bipotential type. In addition, instead of using an electron beam passage hole which is simply elongated horizontally, for example, a horizontally elongated electron beam passage hole which has a burring portion obtained by bending the side walls of the hole may be used. Furthermore, the horizontal and vertical lengths of a side wall may be set to be different from each other. Moreover, the shape of an electron beam passage hole is not limited to a horizontally elongated rectangular shape but may be other shapes such as an elliptic shape.

It is apparent that various methods of forming quadrupole lenses are available in addition to the method described above, and any one of them can be used.

In the second embodiment, the electron gun is designed to emit a single electron beam. If, however, three electron guns of such a type for emitting a single electron beam are arranged in the form of a delta (Δ), a delta gun assembly for a color picture tube can be provided.

Figure 11A:
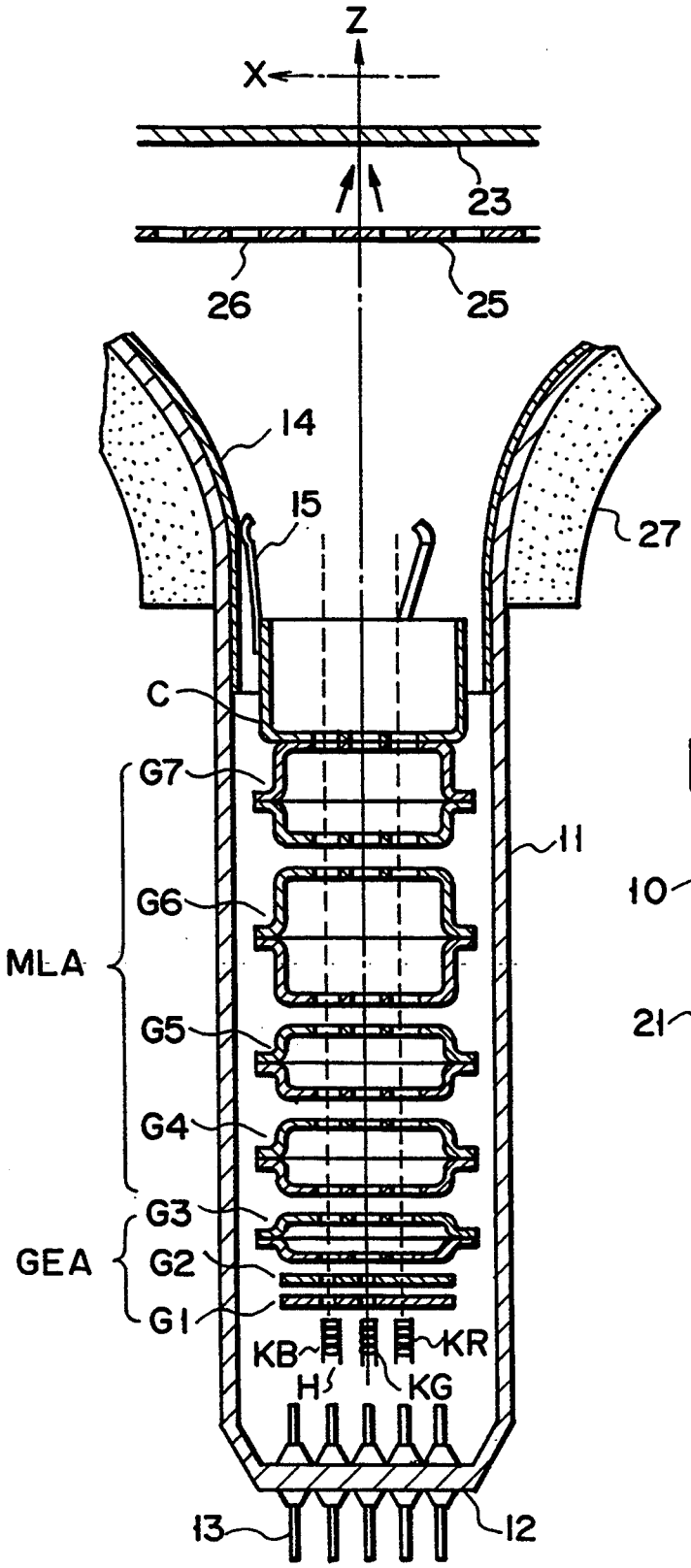
FIGS. 11A and 11B are X–Z and Y–Z sectional views showing the structure of an electron gun assembly for emitting three electron beams according to the third embodiment of the present invention.
Figure 11B:
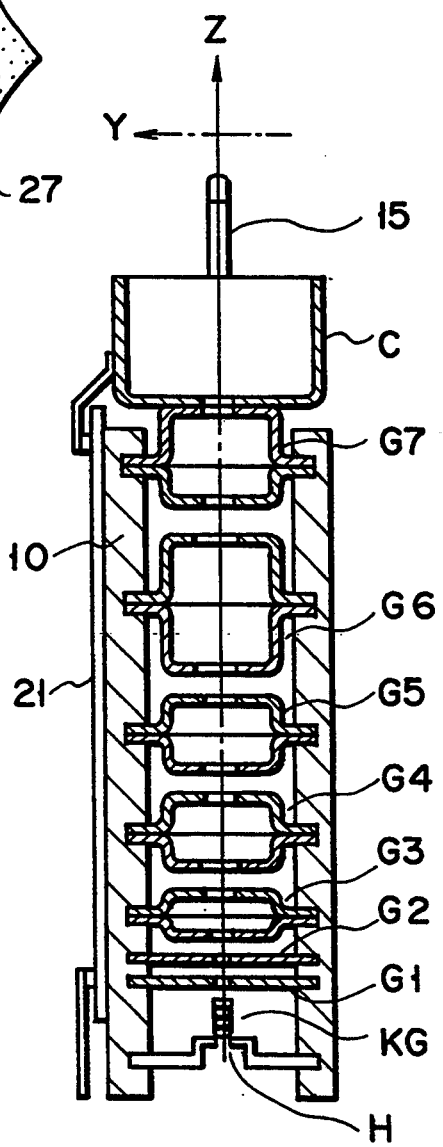

FIGS. 11A and 11B show an in-line gun assembly for a color picture tube, which is designed to emit three electron beams in line, according to the third embodiment of the present invention.

This electron gun assembly comprises three cathodes KB, KG, and KR arranged in one horizontal plane, three heaters H respectively inserted in the cathodes KB, KG, and KR, first to seventh grids G1 to G7, having an integral structure and coaxially arranged at predetermined intervals from the cathodes KB, KG, and KR to a phosphor screen 23 in the order named, and a convergence cup C fixed to the phosphor screen 23 side of the seventh grid G7. The first and second grids G1 and G2 are constituted by plate-like electrodes, whereas each of the third to seventh grids G3 to G7 is constituted by a combination of a plurality of cup-like electrodes. The cathodes KB, KG, and KR, the heaters H, and the first to seventh grids G1 to G7 are integrally fixed by a pair of insulating support members 10. A resistive element 21 is arranged along the rear surface of one of the insulating support members 10.

Referring to FIGS. 11A and 11B, reference numeral 25 denotes a shadow mask having a large number of electron beam passage holes 26 and arranged on the inside of the phosphor screen 23 to oppose it; and 27, a deflection yoke mounted around an envelope. With regard to other components, the same reference numerals in FIGS. 11A and 11B denote the same parts as in FIGS. 3A and 3B, and a description thereof will be omitted.

Figure 12A:
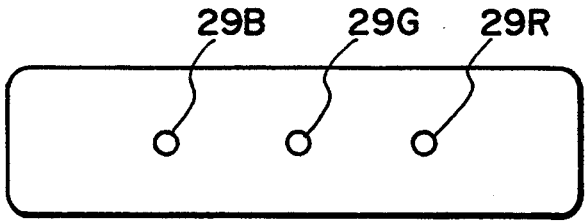
FIG. 12A is a view showing the shapes of electron beam passage holes of each of the first and second grids of the electron gun assembly of the third embodiment.
Figure 12B:
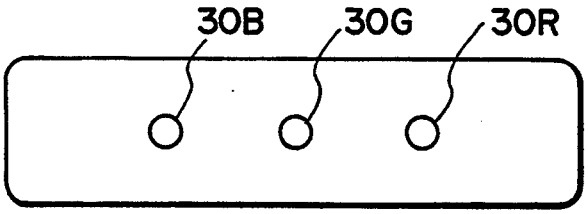
FIG. 12B is a view showing the shapes of electron beam passage holes in the end face of the second grid side of the third grid.

As shown in FIG. 12A, three relatively small circular electron beam passage holes 29B, 29G, and 29R are formed in the plate surface of each of the first and second grids G1 and G2 to oppose the three cathodes KB, KG, and KR in one horizontal plane. As shown in FIG. 12B, B, three circular electron beam passage holes 30B, 30G, and 30R larger than the electron beam passage holes 29B, 29G, and 29R in the second grid G2 are formed in the end face of the second grid G2 side of the third grid G3. The components from the cathodes KB, KG, and KR to the third grid G3 constitute an electron beam forming portion GEA for controlling emission of electrons from the cathodes KB, KG, and KR and focusing the emitted electrons to form three electron beams.

Figure 12C:
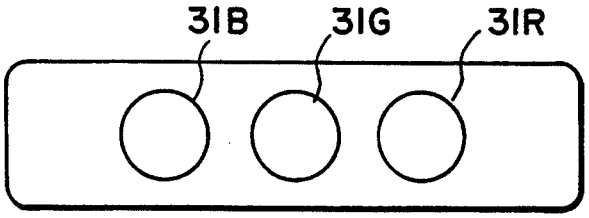
FIG. 12C is a view showing the shapes of electron beam passage holes in the end face of the fourth grid side of the third grid.
Figure 12D:
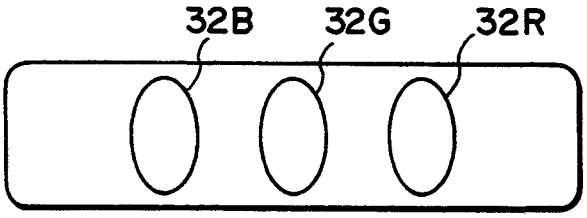
FIG. 12D is a view showing the shapes of electron beam passage holes in the end face of each of the following grid sides: the third grid side of the fourth grid, and the fifth grid side of the sixth grid.
Figure 12E:
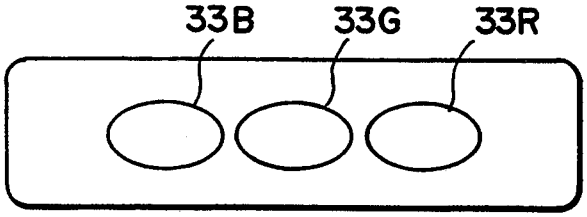
FIG. 12E is a view showing the shapes of electron beam passage holes in the end face of each of the following grid sides: the fifth grid side of the fourth grid, the fourth grid side of the fifth grid, the fifth grid side of the sixth grid, and the sixth grid side of the seventh grid.
Figure 12F:
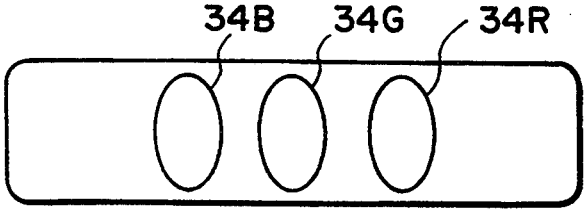
FIG. 12F is a view showing the shapes of electron beam passage holes in the end face of the seventh grid side of the sixth grid.

As shown in FIG. 12C, three circular electron beam passage holes 31B, 31G, and 31R larger than the electron beam passage holes 30B, 30G, and 30R in the end face of the second grid G2 side of the third grid G3 are formed in the end face of the fourth grid G4 side of the third grid G3. In addition, as shown in FIG. 12D, three vertically elongated electron beam passage holes 32B, 32G, and 32R are formed in the end face of each of the following grid sides: the third grid G3 side of the fourth grid G4, and the fifth grid G5 side of the sixth grid side G6. Furthermore, as shown in FIG. 12E, three horizontally elongated electron beam passage holes 33B, 33G, and 33R are formed in the end face of each of the following grid sides: the fifth grid G5 side of the fourth grid G4, the fourth grid G4 side of the fifth grid G5, the fifth grid G5 side of the sixth grid G6, and the sixth grid G6 side of the seventh grid G7. Moreover, as shown in FIG. 12F, three vertically elongated electron beam passage holes 34B, 34G, and 34R are formed in the end face of the seventh grid G7 side of the sixth grid G6. The interval between each of the pair of side beam passage holes 34B and 34R and the center beam passage hole 34G is smaller than that of other sets of electron beam passage holes shown in, e.g., FIG. 12E. That is, the pair of side beam passage holes 34B and 34R are offset toward the center beam passage hole 34G. In this electron gun assembly, the components from the third grid G3 to the seventh grid G7 constitute a main lens portion MLA for focusing and converging electron beams emerging from the electron beam forming portion GEA toward the phosphor screen 23.

The voltages for the respective electrodes of the electron gun assembly are applied in the following manner. The voltages for the cathodes KB, KG, and KR and the first to fifth grids G1 to G5 are applied through stem pins 13. The voltage for the seventh grid G7 is applied through an anode terminal (not shown) arranged in the conical portion of the envelope, an internal conductive film 14, and a valve spacer 15 which is in tight contact with the internal conductive film 14. The voltage for the sixth grid G6 is obtained by dividing the voltage applied to the seventh grid G7 by means of the resistive element 21.

For example, a cutoff voltage of about 150 V is applied to each of the cathodes KB, KG, and KR together with a video signal and the first grid G1 is set at the ground potential, thereby applying the following voltages to the respective electrodes: 500 V to 1 kV to the second grid G2; 5 V to 10 kV to the third and fifth grids G3 and G5; 0 V to 5 kV to the fourth grid G4; 15 V to 25 kV to the sixth grid G6; and a high voltage of 25 V to 30 kV to the seventh grid G7.

Figure 13A:
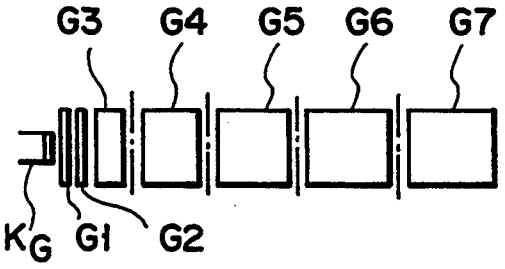
FIG. 13A is a view, showing the arrangement of electrodes in comparison with an electron lens, for explaining the function of each electron lens of the electron gun assembly of the third embodiment.
Figure 13B:
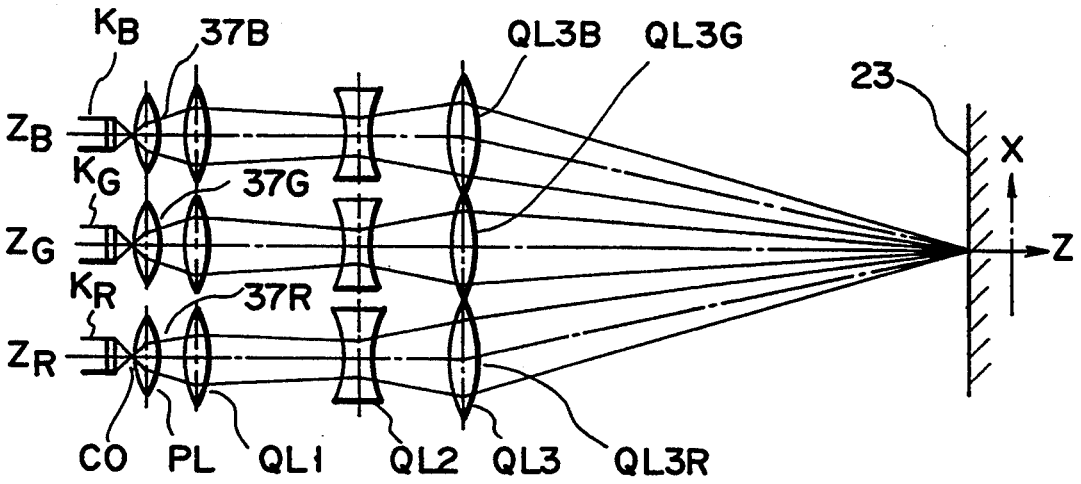
FIGS. 13B and 13C are views showing the arrangement of the electron lenses on the X–Z and Y–Z planes.
Figure 13C:
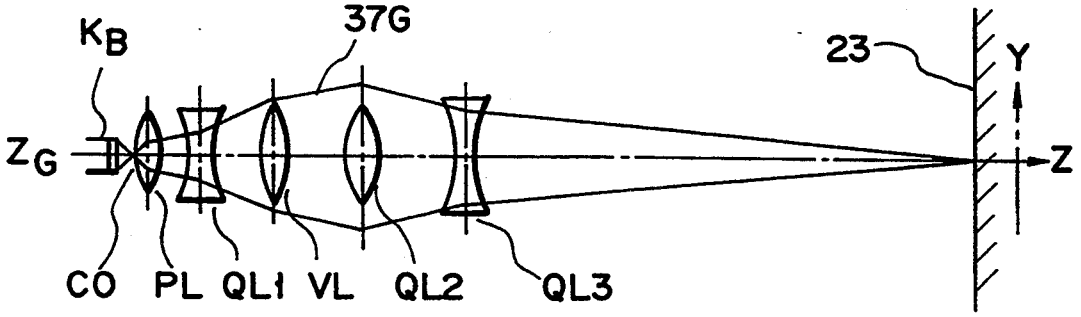

When such voltages are applied, electron lenses shown in FIGS. 13B and 13C in comparison with the arrangement of electrodes in FIG. 13A are formed in the electron gun assembly. Although FIG. 13 shows only the electron lens system associated with the center beam of three electron beams, the same electron lens system is formed with respect to a pair of side beams.

As shown in FIGS. 13A to 13C, electrons emitted from the cathodes KB, KG, and KR in accordance with a modulation signal are caused to cross center axes ZB, ZG, and ZR by the cathodes KB, KG, and KR and the first and second grids G1 and G2 so as to form crossover points CO, respectively. The electrons are then slightly focused horizontally and vertically by prefocus lenses PL formed by the second and third grids G2 and G3 to form three electron beams 37B, 37G, and 37R. The electrons beams 37B, 37G, and 37R diverge and enter the third grid G3.

The three electron beams 37B, 37G, and 37R, which enter the third grid G3, are focused in the horizontal direction and are caused to diverge in the vertical direction by quadrupole lenses QL1 formed by the third and fourth grids G3 and G4. The electron beams 37B, 37G, and 37R are respectively focused mainly in the vertical direction by asymmetrical lenses VL formed by the fourth and fifth grids G4 and G5. Thereafter, the electron beams 37B, 37G, and 37R are caused to diverge in the horizontal direction and focused in the vertical direction by individual quadruple lenses QL2 formed by the fifth and sixth grids G5 and G6. Finally, the electron beams 37B, 37G, and 37R are respectively focused in the horizontal direction and are caused to diverge in the vertical direction by quadrupole lenses QL3 formed by the sixth and seventh grids G6 and G7.

As a result, the three electron beams 37B, 37G, and 37R emerging from the electron beam forming portion GEA can be properly focused horizontally and vertically onto the phosphor screen 23. In this case, the voltages to be applied to the third and fifth grids G3 and G5 through the stem pins 13 are externally adjusted to properly focus the electron beams 37B, 37G, and 37R mainly in the vertical direction, while the voltage to be applied to the fourth grid G4 is adjusted to properly focus the electron beams 37B, 37G, and 37R mainly in the horizontal direction, thus providing a very practicable electron gun assembly. In addition, since the three electron beams 37B, 37G, and 37R are basically focused by the three sets of quadrupole lenses QL1, QL2, and QL3, a high electronic optic magnification can be obtained, and the aberration can be reduced. As a result, the size of a beam spot on the phosphor screen 23 can be decreased.

Note that, as shown in FIG. 12F, since the pair of side beam passage holes 34B and 34R in the end face of the seventh grid G7 side of the sixth grid G6 are offset toward the center beam passage hole 34G, quadrupole lenses QL3B and QL3R, of the quadrupole lenses QL3 formed by the sixth and seventh grids G6 and G7, which correspond to the pair of side beams 37B and 37R, are formed to be offset toward a quadrupole lens QL3G corresponding to the center beam 37G. With this arrangement, the axes ZB and ZR of the pair of side beams 37B and 37R passing through the quadrupole lenses QL3B and QL3R are subjected to the focusing effects, and hence the side beams 37B and 37R are deflected toward the center beam 37G to converge on the phosphor screen 23.

Figure 14A:
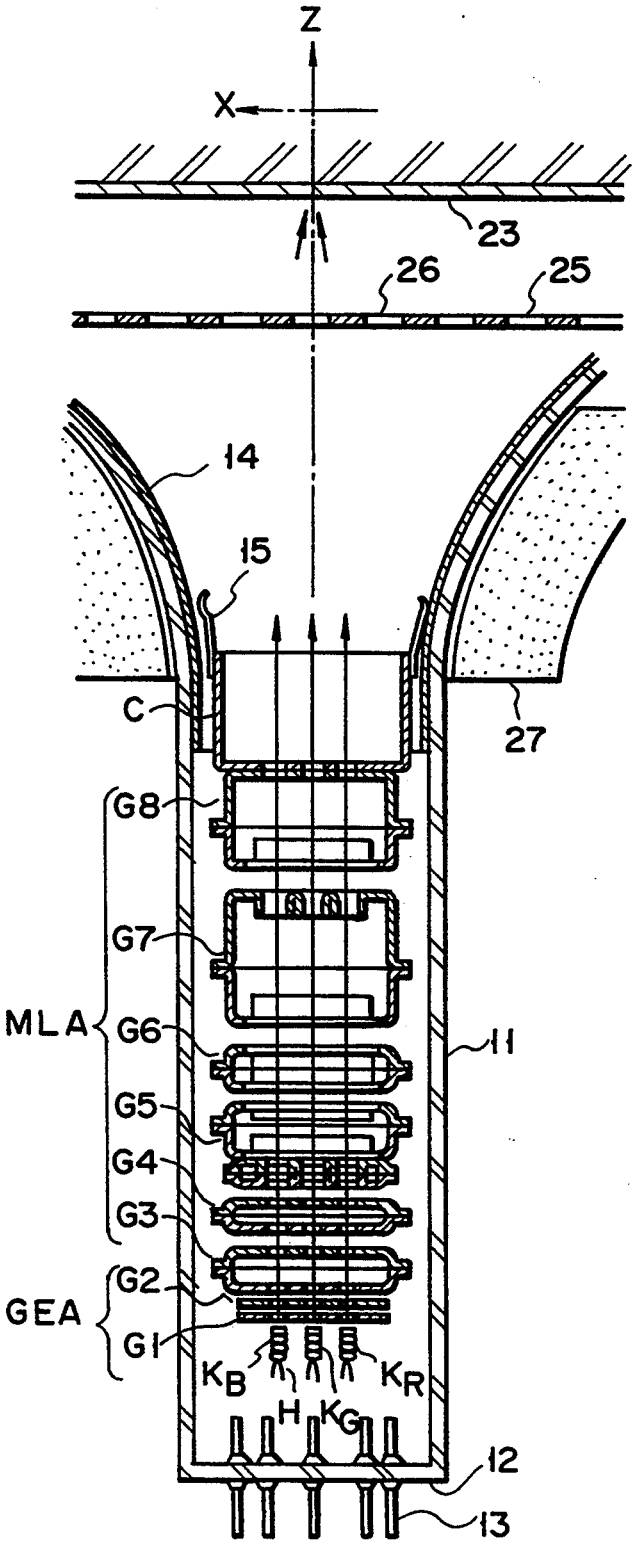
FIGS. 14A and 14B are X–Z and Y–Z sectional views showing the structure of an electron gun assembly for emitting three electron beams according to the fourth embodiment of the present invention.
Figure 14B:
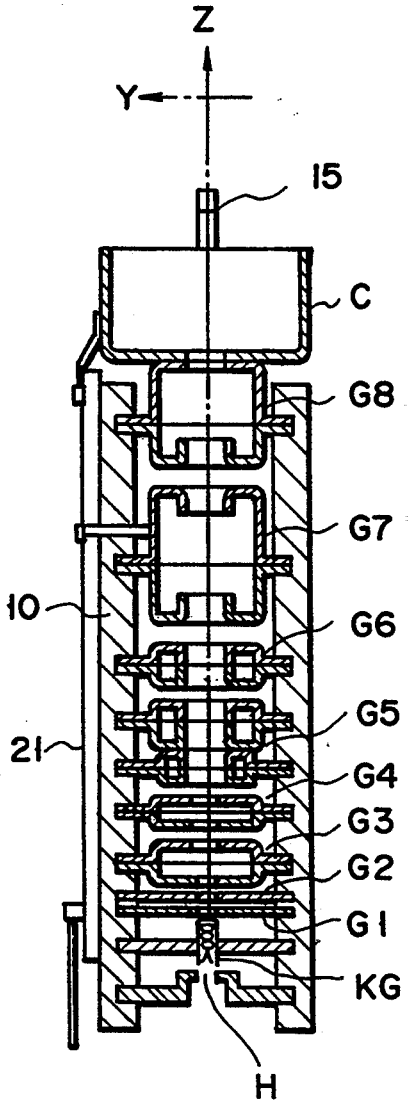

FIG. 14A and 14B show an in-line gun assembly for a color picture tube, which is designed to emit three electron beams in line, according to the fourth embodiment of the present invention.

Similar to the electron gun assembly of the third embodiment, this electron gun assembly comprises three cathodes KB, KG, and KR arranged in one horizontal plane, three heaters H respectively inserted in the cathodes KB, KG, and KR, first to eighth grids G1 to GS, having an integral structure and coaxially arranged at predetermined intervals from the cathodes KB, KG, and KR to a phosphor screen 23 in the order named, and a convergence cup C fixed to the phosphor screen 23 side of the eighth grid G8. The first and second grids G1 and G2 are constituted by plate-like electrodes, whereas each of the third to eighth grids G3 to G8 is constituted by a combination of a plurality of cup-like electrodes. The cathodes KB, KG, and KR, the heaters H, and the first to eighth grids G1 to G8 are integrally fixed by a pair of insulating support members 10. A resistive element 21 is arranged along the rear surface of one of the insulating support members 10.

Figure 15A:
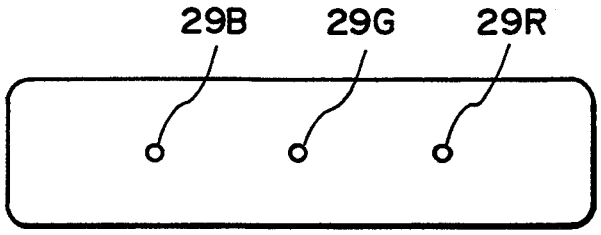
FIG. 15A is a view showing the shapes of electron beam passage holes of each of the first and second grids of the electron gun assembly of the fourth embodiment.
Figure 15B:
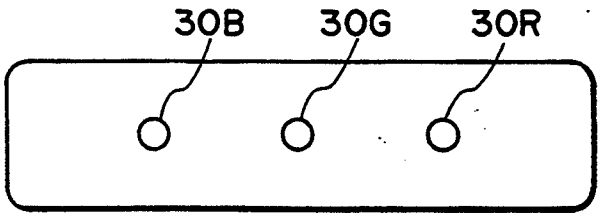
FIG. 15B is a view showing the shapes of electron beam passage holes in the end face of the second grid side of the third grid.

As shown in FIG. 15A, three relatively small circular electron beam passage holes 29B, 29G, and 29R are formed in the plate surface of each of the first and second grids G1 and G2 to oppose the three cathodes KB, KG, and KR in one horizontal plane. As shown in FIG. 15B, three circular electron beam passage holes 30B, 30G, and 30R larger than the electron beam passage holes 29B, 29G, and 29R in the second grid G2 are formed in the end face of the second grid G2 side of the third grid G3. The components from the cathodes KB, KG, and KR to the third grid G3 constitute an electron beam forming portion GEA for controlling emission of electrons from the cathodes KB, KG, and KR and focusing the emitted electrons to form three electron beams.

Figure 5:
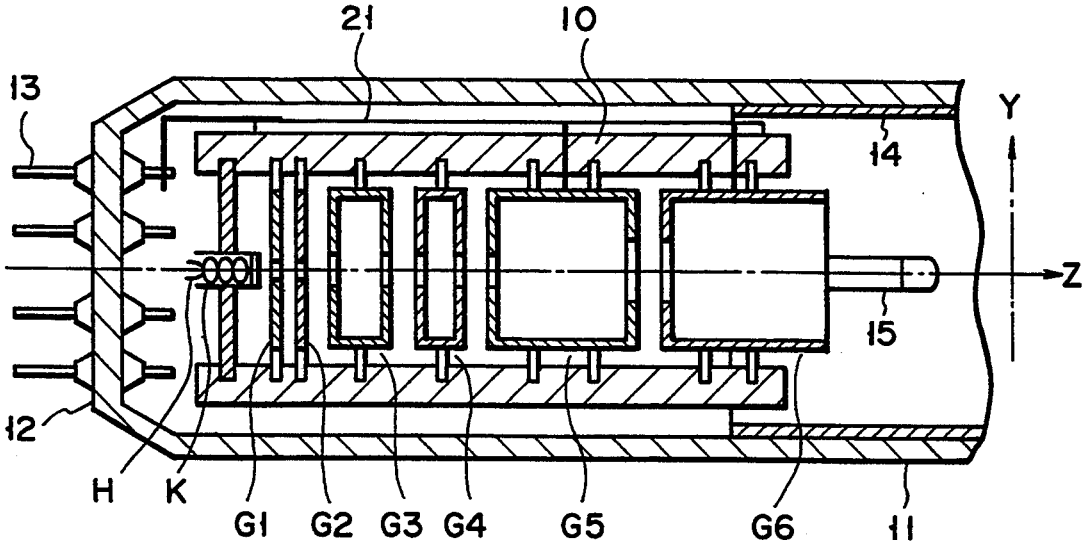
FIG. 5 is a sectional view showing the arrangement of an electron gun equivalent to the electron gun in FIG. 3A in which a resistive element is additionally arranged.
Figure 15C:
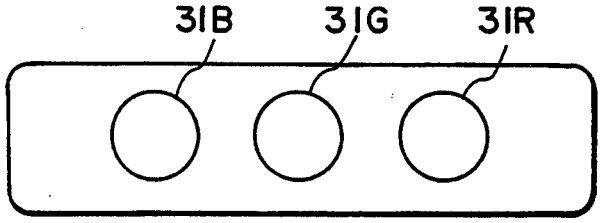
FIG. 15C is a view showing the shapes of electron beam passage holes in the end face of each of the following grid sides: the fourth grid side of the third grid, the third grid side of the fourth grid, and the fifth grid side of the fourth grid.
Figure 15D:
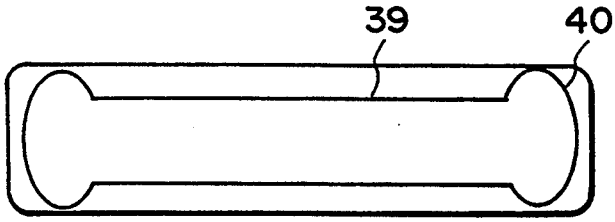
FIG. 15D is a view showing the shapes of electron beam passage holes in the end face of each of the following grid sides: the sixth grid side of the fifth grid, the seventh grid side of the sixth grid, the sixth grid side of the seventh grid, and the seventh grid side of the eighth grid.
Figure 15E:
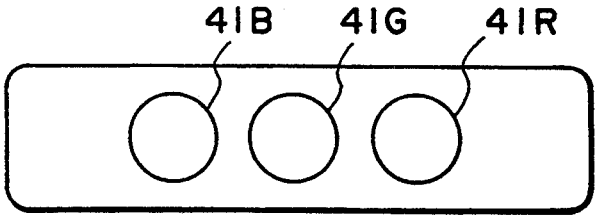
FIG. 15E is a view showing the shapes of electron beam passage holes in the end face of the eighth grid side of the seventh grid.

As shown in FIG. 15C, three circular electron beam passage holes 31B, 31G, and 31R larger than the electron beam passage holes 30B, 30G, and 30R in the end face of the second grid G2 side of the third grid G3 are formed in the end face of each of the following gride sides: the fourth grid G4 side of the third grid G3, the third grid G3 side of the fourth grid G4, and the fifth grid G5 side of the fourth grid G4. In addition, as shown in FIG. 15D, one horizontally elongated electron beam passage hole 40 having large-diameter portions 39 formed at its two ends is formed in the end face of each of the following grid sides: the sixth grid G6 side of the fifth grid G5, the fifth grid G5 side of the sixth grid G6, the seventh grid G7 side of the sixth grid G6, the sixth grid G6 side of the seventh grid G7, and the seventh grid G7 side of the eighth grid G8. Furthermore, as shown in FIG. 15E, three circular electron beam passage holes 41B, 41G, and 41R which are relatively large, similar to the electron beam passage holes 31B, 31G, and 31R shown in FIG. 5C and formed in, e.g., the fourth grid G4, are formed in the end face of the eighth grid G8 side of the seventh grid G7 with the side beam passage holes 41B and 41R being offset toward the center beam passage hole 41G. The components from the third grid G3 to the eight grid G8 constitute a main electron lens portion MLA for focusing and converging three electron beams emerging from the electron beam forming portion GE onto the phosphor screen 23.

The voltages for the respective electrodes of the electron gun assembly are applied in the following manner. The voltages for the cathodes KB, KG, and KR and the first to sixth grids G1 to G6 are applied through stem pins 13. The voltage for the eighth grid G8 is applied through an anode terminal (not shown) arranged in the conical portion of the envelope, an internal conductive film 14, and a valve spacer 15 which is in tight contact with the internal conductive film 14. The voltage for the seventh grid G7 is obtained by dividing the voltage applied to the eighth grid G8 by means of the resistive element 21.

For example, a cutoff voltage of about 150 V is applied to each of the cathodes KB, KG, and KR together with a video signal and the first grid G1 is set at the ground potential, thereby applying the following voltages to the respective electrodes: 500 V to 1 kV to the second grid G2; 5 V to 10 kV to the third and fifth grids G3 and G5; 0 V to 5 kV to the fourth and sixth grids G4 and G6; 15 V to 25 kV to the seventh grid G7; and a high voltage of 25 V to 30 kV to the eighth grid G8.

Figure 16A:
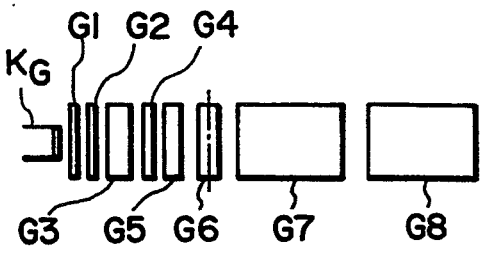
FIG. 16A is a view, showing the arrangement of electrodes in comparison with an electron lens, for explaining the function of each electron lens of the electron gun assembly of the fourth embodiment.
Figure 16B:
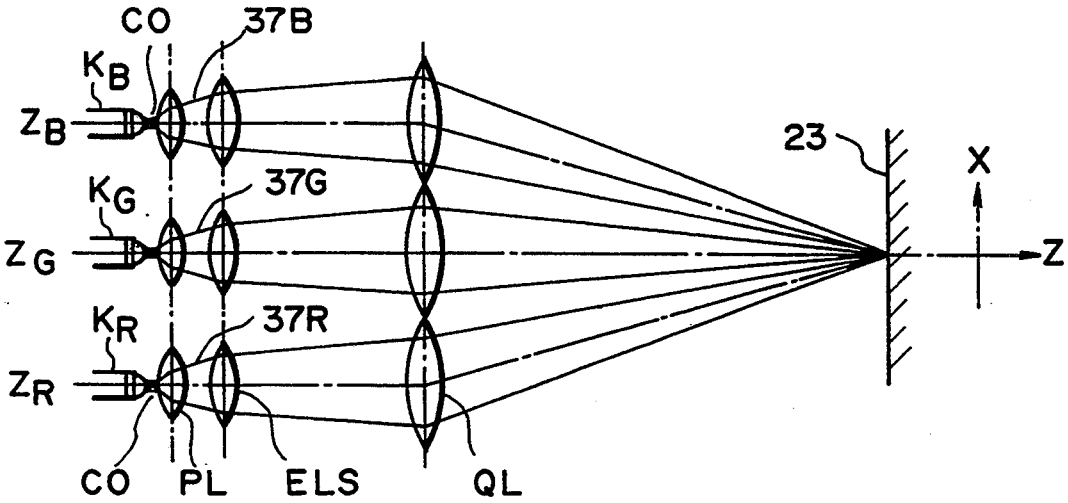
FIGS. 16B and 16C are views respectively showing the arrangements of the electron lenses on the X–Z and Y–Z planes.
Figure 16C:
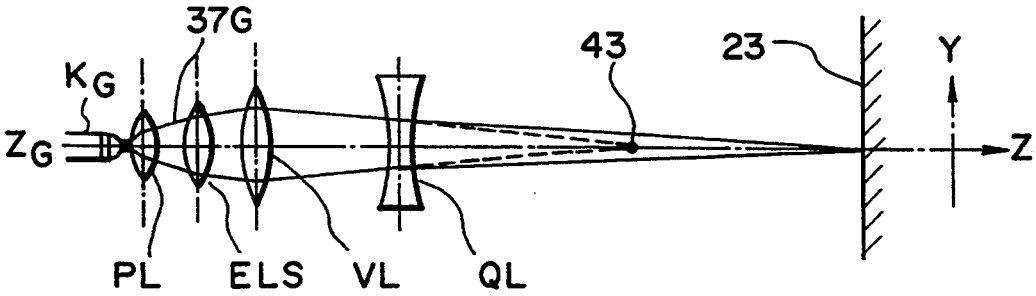

When such voltages are applied, electron lenses shown in FIGS. 16B and 16C in comparison with the arrangement of electrodes in FIG. 16A are formed in the electron gun assembly. Although FIG. 16C shows only the electron lens system associated with the center beam of three electron beams, the same electron lens system is formed with respect to a pair of side beams.

As shown in FIGS. 16A to 16C, electrons emitted from the cathodes KB, KG, and KR in accordance with a modulation signal are caused to cross center axes ZB, ZG, and ZR by the cathodes KB, KG, and KR and the first and second grids G1 and G2 so as to form cross-over points CO, respectively. The electrons are then slightly focused horizontally and vertically by prefocus lenses PL formed by the second and third grids G2 and G3 to form three electron beams 37B, 37G, and 37R. The electrons beams 37B, 37G, and 37R diverge and enter the third grid G3.

The three electron beams 37B, 37G, and 37R, which enter the third grid G3, are slightly focused in the horizontal and vertical directions by individual weak cylindrical electron lenses ELS of a unipotential type which are formed by the third, fourth, and fifth grids G3, G4, and G5. Subsequently, the three electron beams 37B, 37G, and 37R are strongly focused in the vertical direction by a unipotential type asymmetrical electron lens VL common to the three electron beams 37B, 37G, and 37R, which is formed by the elongated electron beam passage holes in the fifth, sixth, and seventh grids G5, G6, and G7 and has a strong focusing effect in the vertical direction. In this case, the large-diameter portions are formed at the two ends of each of the electron beam passage holes which are respectively formed in the fifth, sixth, and seventh grids G5, G6, and G7 so as to form the asymmetrical electron lens VL common to the three electron beams 37B, 37G, and 37R. Owing to these large-diameter portions, the pair of side beams 37B and 37R are free from the influences of the edges of the electron beam passage holes in the horizontal direction. Therefore, three electron beams 37B, 37G, and 37R are subjected to substantially the same focusing effect.

The three electron beams 37B, 37G, and 37R strongly focused in the vertical direction by the asymmetrical lens VL are caused to converge on a point 43 before the phosphor screen 23, as indicated by dotted lines in FIG. 16C. These three electron beams 37B, 37G, and 37R are subsequently focused in the horizontal direction by three independent quadrupole lenses QL formed by the three circular electron beam passage holes in the end face of the eighth grid G8 side of the seventh grid G7 and the horizontally elongated electron beam passage holes in the end face of the seventh grid G7 side of the eighth grid G8. At the same time, the three electron beams 37B, 37G, and 37R, which are caused to converge on the point 43 before the phosphor screen 23 as indicated by the dotted lines in FIG. 16C, are caused to diverge by the quadrupole lenses QL, as indicated by solid lines in FIG. 16C. As a result, the three electron beams 37B, 37G, and 37R are horizontally and vertically focused and converged onto the phosphor screen 23. In this case, since the side beam passage holes in the end face of the eighth grid G8 side of the seventh grid G7 are offset toward the center beam passage hole, the pair of side beams 37B and 37R are deflected toward the center beam 37G. Therefore, the three electron beams 37B, 37G, and 37R are caused to converge on one point on the phosphor screen 23.

That is, in this electron gun assembly for a color cathode ray tube, the main electron lens portion MLS is constituted by the quadrupole lenses QL to eliminate a large spherical aberration due to a cylindrical electron lens of a conventional electron gun for a cathode-ray tube, thereby properly focusing the three electron beams 37B, 37G, and 37R onto the phosphor screen 23. In addition, since an electron beam in the deflection center can be reduced in diameter in the vertical direction, a deflection error due to the deflection yoke 27 is not easily caused. Therefore, the distortion of a beam spot at the peripheral portion of the phosphor screen 23 can be reduced. Furthermore, if a dynamic focus scheme in which the potential of the sixth grid G6 is increased, in synchronism with the deflection of an electron beam by means of the deflection yoke 27, as the electron beam approaches the peripheral portion of the phosphor screen 23 is employed, the focusing effect of the asymmetrical electron lens VL formed by the fifth, sixth, and seventh grids G5, G6, and G7 is reduced to eliminate a deflection error at the peripheral portion of the phosphor screen 23. Moreover, according to this electron gun assembly, since the performance of each electron lens can be improved, the three electron beams 37B, 37G, and 37R can be more easily caused to converge on one point on the phosphor screen 23 by reducing the three electron beam passage holes in size so as to decrease the intervals between the three electron beams 37B, 37G, and 37R. This enables excellent convergence and allows a reduction in power for deflection.

That is, the electron gun assembly of this embodiment is characterized in that the electron beams 37B, 37G, and 37R are respectively focused by the quadrupole lenses QL onto the phosphor screen 23. Therefore, in comparison with a conventional electron gun assembly using cylindrical lenses, a beam spot on the phosphor screen 23 can be reduced in size to improve the resolution.

In an electron gun assembly, disclosed in, e.g., Published Unexamined Japanese Patent Application Nos. 1-267939, 2-60029, and 2-192646, in which a large-aperture electron lens common to three electron beams is formed by a large cylindrical electrode and a larger cylindrical electrode enclosing the large cylindrical electrode so as to finally focus the three electron beams on a phosphor screen, the spots of a pair of side beams are distorted because of the aberration of the cylindrical lens, and it is difficult to correct this distortion. Assume that such an electron gun assembly can be designed to reduce this distortion to a negligible level. In this case, in order to reduce the aberration, the diameter of each cylindrical electrode must be set to be considerably large with respect to the intervals of the three electron beams. For this reason, the diameter of a neck for sealing the electron gun assembly is increased, and the deflection power of a deflection yoke is increased. Therefore, such an arrangement is economically undesirable. Furthermore, in this electron gun assembly, since a high voltage of 25 to 30 kV is applied to the larger cylindrical electrode enclosing the large cylindrical electrode to which an intermediate voltage of 5 to 10 kV is applied, the large-aperture electron lens formed by these electrodes is very undesirable in terms of the withstand voltage.

In the electron gun assembly of this embodiment, however, since the three electron beams 37B, 37G, and 37R are respectively focused by the quadrupole lenses QL onto the phosphor screen 23, the problems of the conventional electron gun assembly described above are not posed, and the problem of the withstand voltage, as one of the problems of the electron gun assembly, in which an electrode is enclosed by a larger electrode, can be solved. In addition, differences in potential between the respective electrodes in this embodiment are very small in comparison with the conventional electron gun assembly using independent cylindrical electron lenses. This also improves the reliability of the electron gun assembly in terms of the withstand voltage, thereby increasing its practical value.

In the fourth embodiment, the weak unipotential type cylindrical electron lens is formed by the third, fourth, and fifth grids. This cylindrical electron lens, however, is formed only for the electronic optic magnification, but is not directly associated with the present invention. Therefore, this cylindrical electron lens can be omitted or replaced with another type of electron lens.

Figure 17A:
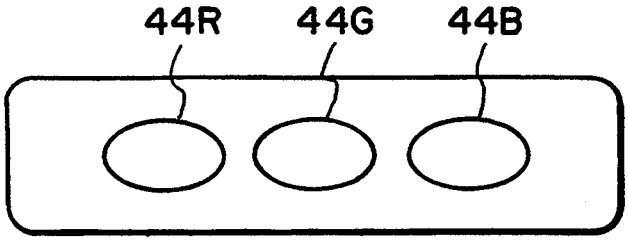
FIGS. 17A to 17D are views showing the shapes of the different electron beam passage holes and of different electrodes constituting asymmetrical electron lenses and quadrupole lenses.
Figure 17B:
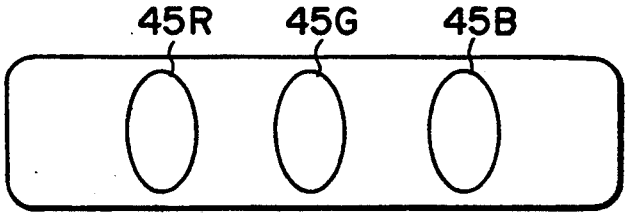
Figure 17C:
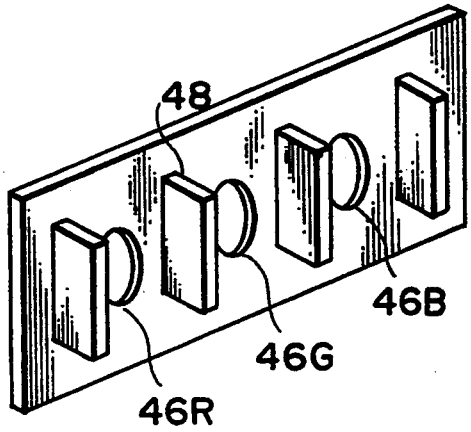
Figure 17D:
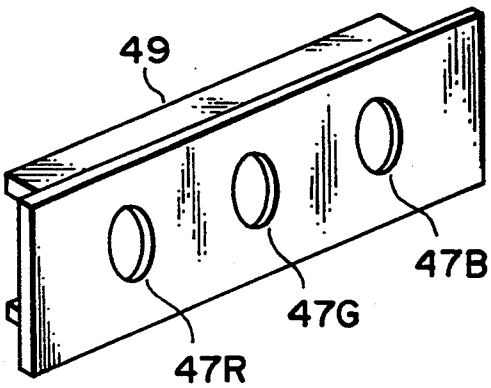

In the fourth embodiment, in order to form the asymmetrical lens and the quadrupole lenses, the horizontally elongated electron beam passage holes are formed in the end face of each of the following grid sides: the sixth grid side of the fifth grid, the fifth grid side of the sixth grid, the seventh grid side of the sixth grid, the sixth grid side of the seventh grid, and the seventh grid side of the eight grid, a the three electron beam passage holes, two of which are offset, are formed in the end face of the eight grid side of the seventh grid, as shown in FIGS. 15D and 15E. However, these electron lenses can be formed by a combination of electrodes in which horizontally elongated three electron beam passage holes 44B, 44G, and 44R, and vertically elongated three electron beam passage holes 45B, 45G, and 45R are formed, as shown in FIGS. 17A and 17B, or a combination of electrodes in which three electron beams 46B, 46G, and 46R with vertical projections 48, and three electron beam passage holes 47B, 47G, and 47R with horizontal projections 49 are formed, as shown in FIGS. 17C and 17D.

In addition, in the fourth embodiment, an asymmetrical electron lens having a focusing effect in the vertical direction and a quadrupole lens having a divergence effect in the vertical direction are combined. However, the present invention is not limited to this combination but may employ a combination of an asymmetrical electron lens having a focusing effect in the horizontal direction and a quadrupole lens having a divergence effect in the horizontal direction.

Figure 18A:
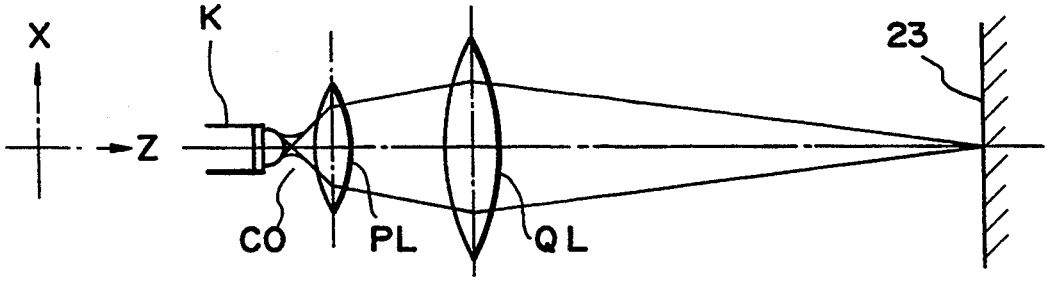
FIGS. 18A and 18B are views of the arrangements of an electron lens on the X–Z and Y–Z planes, showing an optical model having an arrangement different from that of the electron gun in FIG. 3A.
Figure 18B:
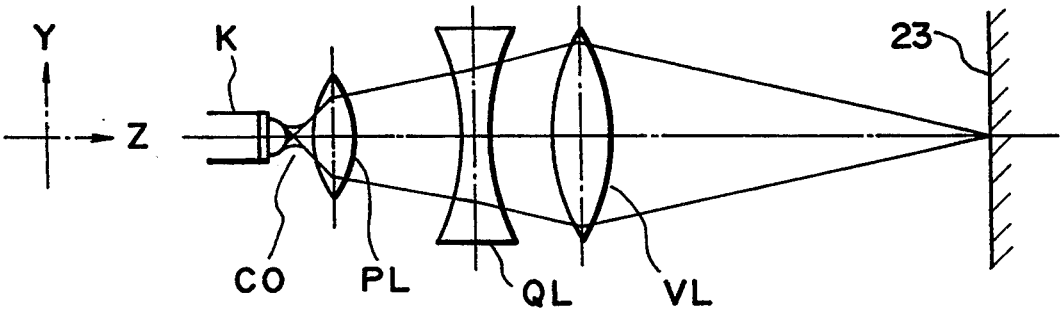

Furthermore, the fourth embodiment employs a combination of an asymmetrical electron lens on the cathode side and a quadrupole lens on the phosphor screen side. As indicated by an optical model in FIGS. 18A and 18B, however, even if the quadrupole lens QL is arranged on the cathode K side; and the asymmetrical electron lens VL, on the phosphor screen 23 side, a required electron gun can be formed.

Figure 19A:
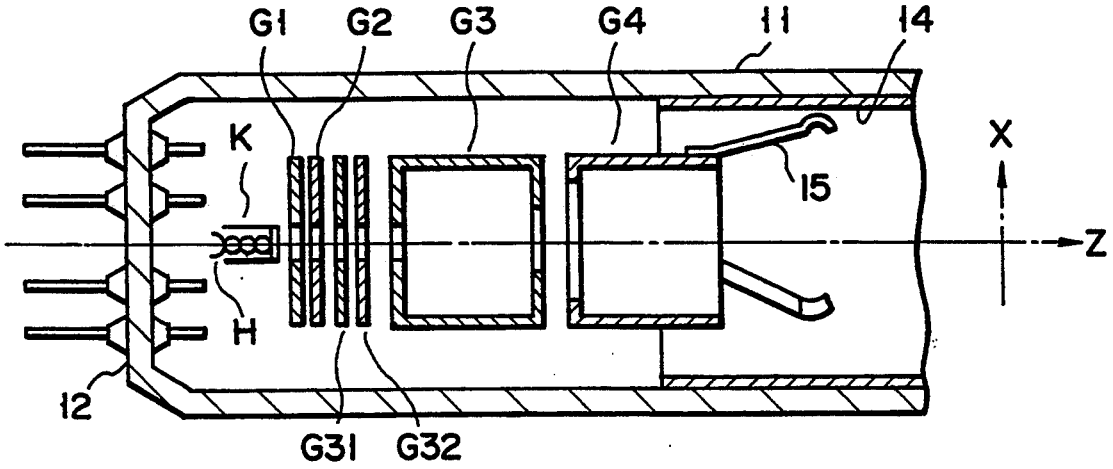
FIGS. 19A and 19B are X–Z and Y–Z sectional views showing an electron gun assembly in which asymmetrical electrons lens are differently arranged.
Figure 19B:
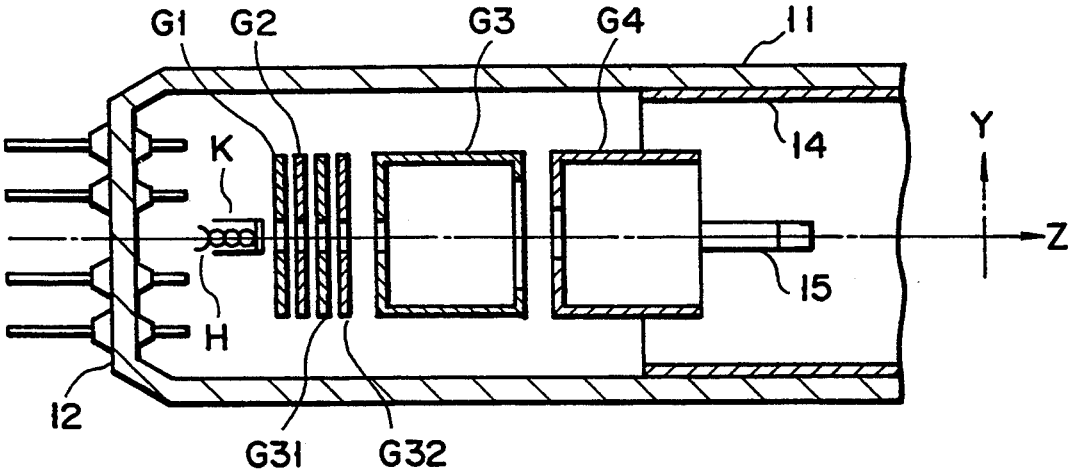

Moreover, in each embodiment described above, the asymmetrical lens is arranged in the main electron lens portion. However, a required electron gun can be formed even if this asymmetrical electron lens is arranged in the electron beam forming portion. FIGS. 19A and 19B show such an arrangement. In this electron gun, plate-like grids G31 and G32 in which horizontally elongated electron beam passage holes are formed are arranged between second and third grids G2 and G3, and an asymmetrical electron lens VL having a strong focusing effect mainly in the vertical direction is formed in an electron beam forming portion GEA constituted by a cathode K, a first grid G1, the second grid G2, the plate-like grids G31 and G32, and the third grid G3. If the asymmetrical electron lens VL is formed in the electron beam forming portion GEA in this manner, the asymmetrical electron lens formed by the cylindrical third, fourth, and fifth grids in each embodiment can be omitted, thus allowing the formation of a short electron gun.

In an electron gun for a cathode-ray tube, if an asymmetrical electron lens having a strong focusing effect mainly in one of orthogonal directions is formed in an electron beam forming portion or a main electron lens portion, and a quadrupole lens having a divergence effect in the direction of the focusing effect of the asymmetrical electron lens and a focusing direction in a direction perpendicular to the direction of the divergence effect is formed in the main electron lens portion, the lens performance of the main electron lens portion can be greatly improved by taking full advantage of the characteristics of the quadrupole lens. In addition, owing to the combination of the asymmetrical electron lens and the quadrupole lens, setting of an electrode structure and electrode potential is greatly facilitated. Furthermore, an electron gun for emitting an electron beam which is not easily influenced by a deflection error of a deflection yoke can be provided. Moreover, an electron gun which can easily perform dynamic correction can be provided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electron gun for a cathode-ray tube including a phosphor screen, comprising:

a cathode for generating an electron beam;

a plurality of electrodes constituting:

a prefocusing lens for prefocusing the electron beam;

a quadruple main focusing lens for both focusing the electron beam in one of a horizontal and vertical direction and causing a divergence effect in another of said horizontal and vertical direction, the quadruple main focusing lens focusing the electron beam on said phosphor screen by focusing mainly in said one direction; and an asymmetrical secondary focusing lens for both suppressing the divergence effect of said quadruple main focusing lens and focusing the electron beam on said phosphor screen, said asymmetrical secondary focusing lens having a focusing effect mainly in the direction of said divergence effect of said quadruple main focusing lens.

2. An electron gun according to claim 1, wherein said quadrupole lens comprises first and second quadrupole lens portions having different phases.

3. An electron gun according to claim 1, wherein said quadrupole lens comprises first and second quadrupole lens portions having the same phase.

4. An electron gun according to claim 2, wherein the phase difference of said first and second quadrupole lens portions is 90 degrees.

5. An electron gun according to claim 2, wherein said quadruple lens and asymmetrical lens are arranged from said cathode to said phosphor screen in the following order: asymmetrical lens, first quadruple lens portion, and second quadruple lens portion.

6. An electron gun according to claim 2, wherein said quadruple lens and asymmetrical lens are arranged from said cathode to said phosphor screen in the following order: first quadruple lens portion, asymmetrical lens, and second quadruple lens portion.

7. An electron gun according to claim 2, wherein said quadruple lens and asymmetrical lens are sequentially arranged from said cathode to said phosphor screen in the following order: first quadruple lens portion, second quadruple lens portion, and asymmetrical lens.

8. An electron gun according to claim 1, wherein said quadrupole lens has a divergence effect in the vertical direction.

9. An electron gun according to claim 1, wherein said quadrupole lens has a divergence effect in the horizontal direction.

10. An electron gun for a cathode-ray tube including a phosphor screen comprising:

a cathode for generating an electron beam;

two plate-like electrodes constituting a prefocusing lens, for prefocusing and forming said electron beam;

a first set of two cylindrical electrodes constituting a quadruple main focusing lens for both focusing the electron beam in one of a horizontal and vertical direction and causing a divergence effect in another of said horizontal and vertical direction; and a second set of two cylindrical electrodes constituting an asymmetrical secondary focusing lens for both suppressing the divergence effect of the quadruple main focusing lens and focusing the electron beam on the phosphor screen, said asymmetrical secondary focusing lens having a focusing effect mainly in the direction of said divergence effect of said quadruple main focusing lens.

11. An electron gun for a cathode-ray tube including a phosphor screen comprising:

a cathode for generating an electron beam;

two plate-like electrodes constituting a prefocusing lens, for prefocusing and forming said electron beam;

a first set of cup-like electrodes constituting a quadruple main focusing lens for both focusing the electron beam in one of a horizontal and vertical direction and causing a divergence effect in another of said horizontal and vertical direction, the quadruple main focusing lens focusing the electron beam onto the phosphor screen; and a second set of cup-like electrodes constituting an asymmetrical secondary focusing lens for both suppressing the divergence effect of the quadruple main focusing lens and focusing the electron beam on the phosphor screen, said asymmetrical secondary focusing lens having a focusing effect mainly in the direction of said divergence effect of said quadruple main focusing lens.

* * * * *